US009261331B2

(12) United States Patent
Gur et al.

(10) Patent No.: US 9,261,331 B2
(45) Date of Patent: Feb. 16, 2016

(54) METHOD AND DEVICE USEFUL FOR AIMING A FIREARM

(71) Applicant: Dr. Erez Gur Ltd., Kfar Saba (IL)

(72) Inventors: Erez Gur, Kfar Saba (IL); Nir Shvalb, Nesher (IL); Boaz Ben-Moshe, Herzliya (IL)

( * ) Notice: Subject to any disclaimer, the term of this patent is extended or adjusted under 35 U.S.C. 154(b) by 118 days.

(21) Appl. No.: 13/912,772

(22) Filed: Jun. 7, 2013

(65) Prior Publication Data

US 2013/0326923 A1 Dec. 12, 2013

(30) Foreign Application Priority Data

Jun. 7, 2012 (IL) ..... 220257

(51) Int. Cl.
*F41G 1/473* (2006.01)
*F41G 3/06* (2006.01)
*F41G 3/16* (2006.01)

(52) U.S. Cl.
CPC *F41G 1/473* (2013.01); *F41G 3/06* (2013.01); *F41G 3/16* (2013.01)

(58) Field of Classification Search
CPC ..... F41G 1/00; F41G 1/473; F41G 3/06; F41G 3/08; F41G 11/00; F41C 27/00; G01C 3/04
USPC ..... 42/111, 135, 142, 1.01; 89/200; 235/414, 415, 416
See application file for complete search history.

(56) References Cited

U.S. PATENT DOCUMENTS 3,647,298 A 3/1972 Soules
3,824,699 A * 7/1974 Lenz et al. ..... 33/334
4,967,641 A * 11/1990 Chambre ..... 89/41.08
5,943,296 A * 8/1999 Moyers, Jr. ..... 367/116
(Continued)

FOREIGN PATENT DOCUMENTS

EP 10275028 EP 3/2010
WO WO 83/00919 3/1983

OTHER PUBLICATIONS

Bill Riggs; Patent Act 1977; Examination Report under Section 18(3); IPO Patent Search, May 13, 2014, pp. 1-3.
(Continued)

*Primary Examiner* — Benjamin P Lee

(57) ABSTRACT

Disclosed is a method of aiming a firearm operated by an operator, comprising: a) at a range-determining rate of at least as frequent as once a second, determining the range to an object along an aiming line of a firearm; b) generating a signal audible to the operator, wherein at least one characteristic of the audible signal is modulated as a function of said determined range; and c) discharging the firearm in response to the characteristic of the signal. Also disclosed is a device useful in helping to aim a firearm, comprising: a) a range-determining unit configured for mounting on a firearm, further configured for determining the range to an object along an aiming line at a range-determining rate of at least as frequent as once a second; and b) a reporting unit functionally associated with the range-determining unit, configured to generate a signal audible to a human operator, wherein at least one characteristic of the signal is modulated as a function of a range determined by the range-determining unit. Also disclosed is a firearm comprising: a firearm body including a barrel having a muzzle at a distal end; and mounted on the firearm body, a range-determining unit of the device useful in helping to aim a firearm.

20 Claims, 4 Drawing Sheets

(56) References Cited

U.S. PATENT DOCUMENTS

| | | | | |
|---|---|---|---|---|
| 6,269,730 | B1 * | 8/2001 | Hawkes et al. | 89/41.05 |
| 6,899,539 | B1 * | 5/2005 | Stallman et al. | 434/11 |
| 7,966,763 | B1 * | 6/2011 | Schneider et al. | 42/105 |
| 8,074,394 | B2 * | 12/2011 | Lowrey, III | 42/123 |
| 8,209,897 | B2 * | 7/2012 | Schneider et al. | 42/105 |
| 2004/0074132 | A1 * | 4/2004 | Jirina | 42/111 |
| 2006/0005447 | A1 * | 1/2006 | Lenner et al. | 42/111 |
| 2012/0255213 | A1 * | 10/2012 | Panos | 42/115 |

OTHER PUBLICATIONS

Bill Riggs, Patents Act 1977: Search Report under Section 17, IPO Patent Search, Nov. 25, 2013, pp. 1-3.

* cited by examiner

METHOD AND DEVICE USEFUL FOR AIMING A FIREARM

RELATED APPLICATIONS

The present application gains priority from Israel Patent Application IL220257 filed 7 Jun. 2012 which is incorporated by reference as if fully set-forth herein. The present application is related to PCT/IB2011/055466 filed 5 Dec. 2011 and published on 14 Jun. 2012 as WO2012/077039 which is incorporated by reference as if fully set-forth herein.

FIELD AND BACKGROUND OF THE INVENTION

The invention, in some embodiments, relates to methods and devices for helping to aim a firearm, especially a hand-held firearm.

To hit a desired target with a projectile fired from a firearm, an operator (shooter) must aim the barrel of the firearm at the target before discharging the firearm.

Aiming a hand-held firearm is seemingly a simple task: the operator points the barrel at a target. In reality, only experts with hundreds of hours of training are able to point to shoot and consistently hit a target at anything further than point-blank range (less than 1 meter).

For an operator of less than expert ability, the operator must use a gunsight to have a reasonable chance of hitting a target, even a static target.

Surprisingly, hitting a target at close ranges, i.e., from 1 meter to about 30 meters, using a hand-held firearm when the operator is under pressure or an urgent time limit is difficult, even with the help of the standard fixed "iron sights".

The use of advanced combat optical gunsights (ACOG, available, for example, from Trijicon, Wixom, Mich., USA) improves the chance of hitting a target with a shoulder-held weapon such as a rifle. Some such sights are too bulky to be practical for use with handguns. Further, the requirement to focus both the operator's field of view and concentration through the gunsight during aiming means that aiming and discharging the firearm may take a relatively long time and/or the operator may become oblivious to the surroundings.

It is known to use a laser placed in parallel to the barrel of a firearm as laser gunsight. The laser beam illuminates an object with a small (1 mm diameter) spot of light. Such sights are ineffective at ranges above 4 meters due to difficulty in seeing the spot of light especially during day light, while in low-light conditions the use of such a laser gunsight reveals the location of the operator. As with an ACOG, use of a laser gunsight requires that the operator focus both field of view and concentration to see the spot of light with the concomitant disadvantages.

SUMMARY OF THE INVENTION

The invention, in some embodiments, relates to methods for aiming firearms, and to devices useful in helping to aim firearms and to firearms that are relatively easily aimed.

According to an aspect of some embodiments of the invention, there is provided a method of aiming a firearm operated by an operator, comprising:

a) at a range-determining rate at least as frequent as once a second, determining the range to an object along an aiming line of the firearm;

b) generating a signal audible to the operator, wherein at least one characteristic of the audible signal is modulated as a function of the determined range; and c) discharging the firearm in response to the characteristic of the signal.

In some embodiments, the discharging is when the characteristic of the signal indicates to the operator that the firearm is properly aimed.

In some embodiments, the range-determining rate is at least as frequent as 5 times a second. In some embodiments, the range-determining rate is at least as frequent as 10 times a second.

In some embodiments, the audible signal is generated by a reporting unit that is in wireless communication with a component performing the determining of the range. In some embodiments, such a reporting unit is worn by the human operator.

In some embodiments, the audible signal is generated by a reporting unit that is not physically connected to the firearm. In some embodiments, such a reporting unit is worn by the human operator.

In some embodiments, the characteristic of the signal is a frequency of the signal. In some embodiments, the frequency of the signal is such that a higher audible frequency indicates a closer range and a lower audible frequency indicates a longer range. In some embodiments, the frequency of the signal is such that a lower audible frequency indicates a closer range and a higher audible frequency indicates a longer range.

According to an aspect of some embodiments of the invention, there is also provided a device useful in helping to aim a firearm, comprising a) a range-determining unit configured for mounting on a firearm, further configured for determining the range to an object along an aiming line at a range-determining rate of at least as frequent as once a second; and b) a reporting unit functionally associated with the range-determining unit, configured to generate a signal audible to a human operator, wherein at least one characteristic of the signal is modulated as a function of a range determined by the range-determining unit.

In some embodiments, the range-determining rate is at least as frequent as five times a second. In some embodiments, the range-determining rate is at least as frequent as ten times a second.

In some embodiments, the reporting unit in wireless communication with the range-determining unit.

In some embodiments, the reporting unit is not physically connected to the range-determining unit.

In some embodiments, the reporting unit is configured to be worn by a human operator.

In some embodiments, the characteristic of the signal is frequency of the signal. In some embodiments, the frequency is such that a higher audible frequency indicates a closer range and a lower audible frequency indicates a longer range. In some embodiments, the frequency is such that a lower audible frequency indicates a closer range and a higher audible frequency indicates a longer range.

In some embodiments, the device further comprises an activation-switch configured for mounting on the trigger of a firearm so that touching of the trigger causes the activation switch to activate the range-determining unit to determine the range at the range-determining rate and/or to activate the reporting unit to generate the audible signal. In some embodiments, the activation-switch biased to a state so that when no touch of the trigger is detected, the range-determining unit does not determine the range and/or the reporting unit does not generate the audible signal.

According to an aspect of some embodiments of the invention, there is also provided a firearm comprising:

a firearm body including a barrel having a muzzle at a distal end; and mounted on the body, a device useful in helping to aim a firearm as described herein.

Aspects of some embodiments of the teachings herein relate to determining the range to an object along an aiming line of a firearm, and/or to a range-determining unit configured for mounting on a firearm, An exceptionally suitable device for determining the range to such an object and/or an exceptionally suitable such range-determining unit is a variant of the device described in PCT patent application PCT/IB2011/055466 filed 5 Dec. 2011 and published on 14 Jun. 2012 as WO2012/077039. Prior to publication, the PCT patent application in its entirety was included as an Appendix in Israel Patent Application IL220257, the priority document of the instant application, inter alia, providing enabling support for aspects of the invention. Since WO2012/077039 has been published, it is hereby included by reference as if fully set-forth herein.

Unless otherwise defined, all technical and scientific terms used herein have the same meaning as commonly understood by one of ordinary skill in the art to which the invention pertains. In case of conflict, the specification, including definitions, will take precedence.

As used herein, the terms "comprising", "including", "having" and grammatical variants thereof are to be taken as specifying the stated features, integers, steps or components but do not preclude the addition of one or more additional features, integers, steps, components or groups thereof. These terms encompass the terms "consisting of" and "consisting essentially of".

As used herein, the indefinite articles "a" and "an" mean "at least one" or "one or more" unless the context clearly dictates otherwise.

As used herein, the term "aural" and "audible" are used interchangeably.

BRIEF DESCRIPTION OF THE FIGURES

Some embodiments of the invention are described herein with reference to the accompanying figure. The description, together with the figure, makes apparent to a person having ordinary skill in the art how some embodiments of the invention may be practiced. The figure is for the purpose of illustrative discussion and no attempt is made to show structural details of an embodiment in more detail than is necessary for a fundamental understanding of the invention. For the sake of clarity, some objects depicted in the figure are not to scale.

In the Figures.

DESCRIPTION OF SOME EMBODIMENTS OF THE INVENTION

Figure 1:
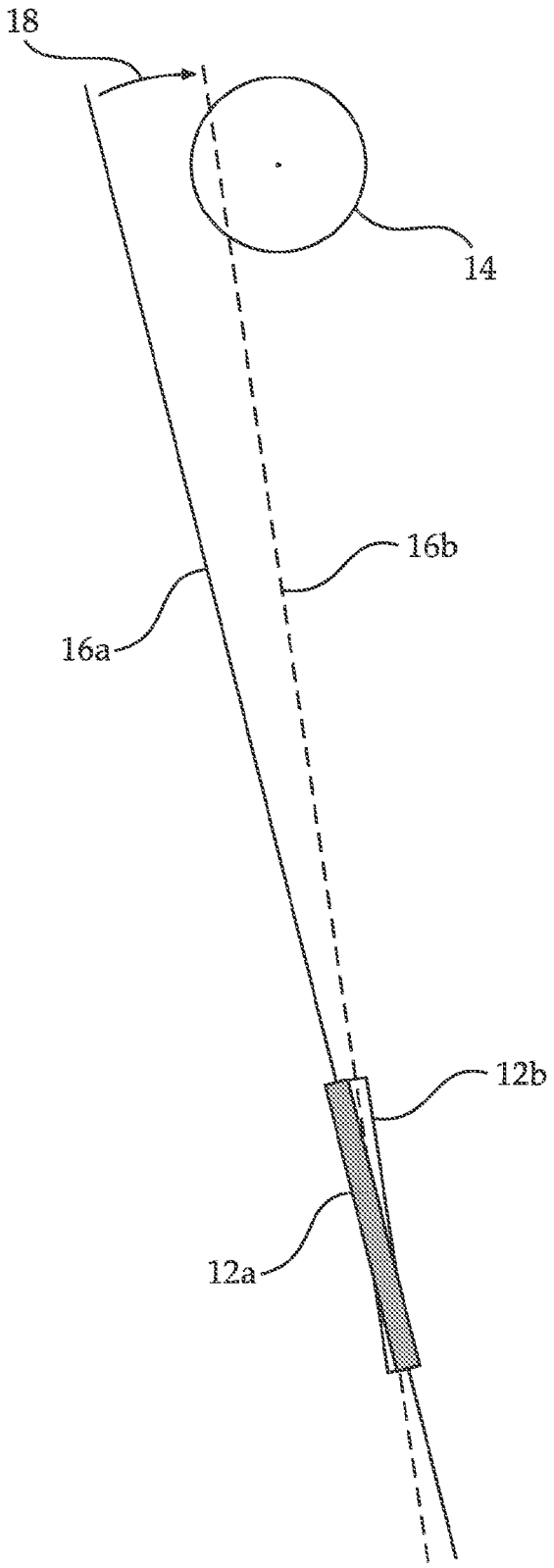
FIG. 1 is a schematic depiction of an implementation of an embodiment of the teachings herein.

The invention, in some embodiments, relates to methods and devices useful in helping to aim a firearm, especially a hand-held firearm, as well as firearms that are relatively easy to aim.

As noted above, aiming a hand-held firearm to hit a target at close range is not simple, especially under challenging conditions (shooting in a short time, moving operator or target, pressure). The use of existing gun-sights to aim has various shortcomings.

The teachings herein, in some embodiments, relates to methods and devices useful in helping to aim a firearm, especially a hand-held firearm. More particularly, in some embodiments the invention relates to determining the range to an object along an aiming line of a firearm at a relatively high rate and generating a signal audible to the operator (of the firearm, the shooter) wherein a characteristic of the signal is modulated as a function of the determined range.

As used herein, the term "firearm" refers to any suitable device for projecting a projectile from the muzzle of a barrel, especially using elevated gas pressure. In some embodiments, the firearm is a deflagration firearm where elevated gas pressure for projecting a projectile is produced by deflagration of a propellant. In some embodiments, the firearm is a pneumatic firearm where elevated gas pressure for projecting a projectile is stored under pressure in a closed vessel and released through a valve.

In some embodiments, the firearm is a hand-held firearm, i.e., a firearm carried and operated by an individual operator.

In some embodiments, the hand-held firearm is a handgun such as a pistol or a revolver.

In some embodiments, the hand-held firearm is a longarm such as a submachine gun, carbine, rifle, assault rifle, battle rifle or shotgun.

In some embodiments, the hand-held firearm is a less-than-lethal weapon such as the FN303 or FN303P (available from FN Herstal, Belgium).

The principles, uses and implementations of the teachings of the invention may be better understood with reference to the accompanying description and figures. Upon perusal of the description and figures present herein, one skilled in the art is able to implement the teachings of the invention without undue effort or experimentation.

Before explaining at least one embodiment of the invention in detail, it is to be understood that the invention is not necessarily limited in its application to the details of construction and the arrangement of the components and/or methods set forth herein. The invention is capable of other embodiments or of being practiced or carried out in various ways. The phraseology and terminology employed herein are for descriptive purpose and should not be regarded as limiting.

Method for Aiming a Firearm

According to an aspect of some embodiments of the teachings herein there is provided a method of aiming a firearm operated by an operator, comprising:

a) at a range-determining rate of at least as frequent as once a second, determining the range to an object along an aiming line of the firearm;

b) generating a signal audible to the operator, wherein at least one characteristic of the audible signal is modulated as a function of the determined range; and c) discharging the firearm in response to the characteristic of the signal.

Typically, the discharging is when the characteristic of the signal indicates to the operator that the firearm is properly aimed, that is to say, aimed in the direction that the operator wants to fire.

In some embodiments, the range-determining and/or the generating of the audible signal commences upon touching of a trigger of the firearm. In some such embodiments, the range-determining and/or the generating of the audible signal stops when the trigger is no longer touched.

In some embodiments, during the determining 'a', the audible signal is continuously generated.

The range-determining rate is any suitable range-determining rate of at least as frequent as once a second. In some embodiments, the range-determining rate is at least as frequent as 5 times a second, at least as frequent as 10 times a second, at least as frequent as 15 times a second, at least as frequent as 30 times a second, at least as frequent as 60 times a second, at least as frequent as 80 times a second, at least as frequent as 100 times a second and even at least as frequent as 200 times a second.

That said, in some embodiments, the greater the range-determining rate, the greater the utility of the device.

Specifically, in embodiments where the range-determining rate is relatively slow (e.g., less frequent than 10 times a second), an operator must point the barrel of the firearm at a target and may have to wait a discernible period of time before hearing the audible signal to know whether or not it is desirable to discharge the firearm.

In contrast, when the range-determining rate is relatively fast (e.g., as frequent as possible, but typically at least as frequent as 10 times a second, more typically at least as frequent as 60 times a second) an operator can point the barrel of the firearm in the direction of a target and substantially immediately hear the audible signal. Further, the operator can move the barrel of the firearm (e.g., sweep the barrel of the firearm in an arc) in the general direction of the target. In many situations (as detailed hereinbelow), such movement leads to a substantially discontinuous change in the characteristic of the audible signal as the firearm moves from being improperly aimed (the characteristic of the signal reflects a range that is not to a desired target) to being properly aimed (the characteristic of the signal reflects a range to the desired target). A substantially discontinuous change in an audible signal is relatively clear and easily discernible.

It is desirable that the range determined is to the point at which a projectile projected by the firearm will impact. Typically, this is not possible at all-possible ranges due to the curved trajectory of a projectile resulting from gravity and due to limitations as to where a range-determining component can be mounted on a firearm relative to the muzzle of the barrel of the firearm. As a result, when implementing the teachings herein the range is determined along an aiming line that is preferably as close as possible to the trajectory of a projectile projected from the firearm at the expected range of use.

It is important to note that embodiments of the teachings herein are countenanced to be useful at close ranges, in some embodiments helping to aim a firearm at a target that is not more than 30 meters distant, in some embodiments not more than 10 meters distant and in in some embodiments not more than 5 meters distant. It is also important to note that for a high-velocity firearm (e.g., having a muzzle velocity above 800 m/sec such as a rifle) the vertical drop of a projectile is in the order of 1 cm at 30 meters, while for a low-velocity firearm (e.g., having a muzzle velocity about 300 msec to 400 msec) the vertical drop of a projectile is in the order of 5 cm at 25 meters.

In some embodiments, the aiming line of a firearm is substantially parallel to the barrel vector (the line passing parallel and concentric with the barrel) of the firearm. In some embodiments, the aiming line of a firearm converges with the barrel vector at a point distant from a muzzle of the firearm in the direction of fire of the firearm.

In some embodiments, at the muzzle of the firearm, the aiming line is offset by not more than 5 cm, not more than 4 cm, not more than 3 cm, and even not more than 2 cm from the barrel vector.

In some embodiments, the audible signal is generated by a reporting unit that is in wireless communication with a component performing the determining of the range. Any suitable wireless modality can be used, including, infrared modality, ultrasonic modality, radio modality (e.g., Bluetooth®, WiFi).

In some embodiments, the audible signal is generated by a reporting unit that is physically connected to the firearm.

In some embodiments, the audible signal is generated by a reporting unit that is not physically connected to the firearm.

In some embodiments, the reporting unit is worn by the human operator.

In some embodiments the reporting unit is an earpiece (analogous to component 68 in FIG. 2 of WO 2012/077039, or as depicted below).

In some embodiments, the reporting unit is a walkie-talkie known in the art of security communications. Such a walkie-talkie typically includes a portable transceiver unit worn at the belt or in a holster functionally associated (typically through a coiled wire) with an earpiece. A walkie-talkie allows security personnel to communicate with commanders and with each other while performing security tasks. In some embodiments of the teachings herein, a walkie-talkie is modified to serve as a reporting unit for implementing the teachings herein in addition to the known walkie-talkie functionalities, for example, by enabling Bluetooth® communication between the walkie-talkie and the component performing the range determining, for example a range-determining unit as described herein.

The characteristic of the audible signal may be modulated in any suitable fashion as a function of the determined range. In some embodiments, the characteristic of the signal is frequency of the signal. In some such embodiments, the frequency is such that a higher audible frequency indicates a closer range and a lower audible frequency indicates a longer range. That said, in some such embodiments the frequency is such that a lower audible frequency indicates a closer range and a higher audible frequency indicates a longer range.

In some embodiments, the audible signal has a frequency between 20 and 20000 Hz. That said, in some embodiments, it is preferred that the audible signal has a frequency between 200 Hz and 800 Hz.

An embodiment of the method according to the teachings herein is schematically depicted in FIG. 1, a view from above of an operator (not depicted) trying to shoot a watermelon 14 with a firearm in two different states superimposed in FIG. 1: wherein 12*a* depicts the firearm in state a (aimed to the left of watermelon 14) and wherein 12*b* depicts the firearm in state b (aimed at watermelon 14).

In state a, the operator is pointing the barrel of firearm 12*a* in the general direction of watermelon 14. However, the barrel of firearm 12*a* is actually aimed so that aiming line 16*a* and the barrel vector are to the left of watermelon 14. In such a state, the characteristic of the audible signal generated in accordance with the teachings herein corresponds to a range to a point that is at a much greater distance than watermelon 14, for instance, the audible signal is a low-frequency tone, wherein a higher audible frequency indicates a closer range and a lower audible frequency indicates a longer range.

As a result, the operator does not discharge firearm 12*a*, but instead, sweeps the barrel of firearm 12*a* to in an arc, such as an arc 18 to the right, as shown in the figure, bringing the firearm to a state b, in which the firearm is depicted as 12*b*.

When the barrel of firearm 12*b* is pointed so that aiming line 16*b* and the barrel vector are aimed at watermelon 14, the audible signal generated in accordance with the teachings herein is modulated such that at least one characteristic of the signal corresponds to the range to watermelon 14, for instance, the audible signal is a high-frequency tone.

Since the operator hears the characteristic of the audible signal that corresponds to the actual range to watermelon 14, and sees that the only object at the correct range at which firearm 12*b* can possibly be aimed at is watermelon 14 the operator understands that firearm 12*b* is properly aimed and discharges firearm 12*b* to hit watermelon 14 with a projectile along a line of fire that is substantially the same as aiming line 16*b*.

It is important to note, that during sweeping of the barrel of firearm 12*a* in arc 18 to 12*b*, from aiming line 16*a* to aiming line 16*b*, there is a substantial discontinuity in the modulation of the audible signal when the aiming line first intersects watermelon 14, e.g., a sudden jump from a low-frequency to a high-frequency tone. Such a substantial discontinuity provides the operator with a reinforcement that firearm 12*b* is properly aimed at watermelon 14. Additionally, such a substantial discontinuity is easily discernible by an operator, even when under intense strain or when focussing on something else, for example, on any unexpected behaviour of watermelon 14.

Figure 2:
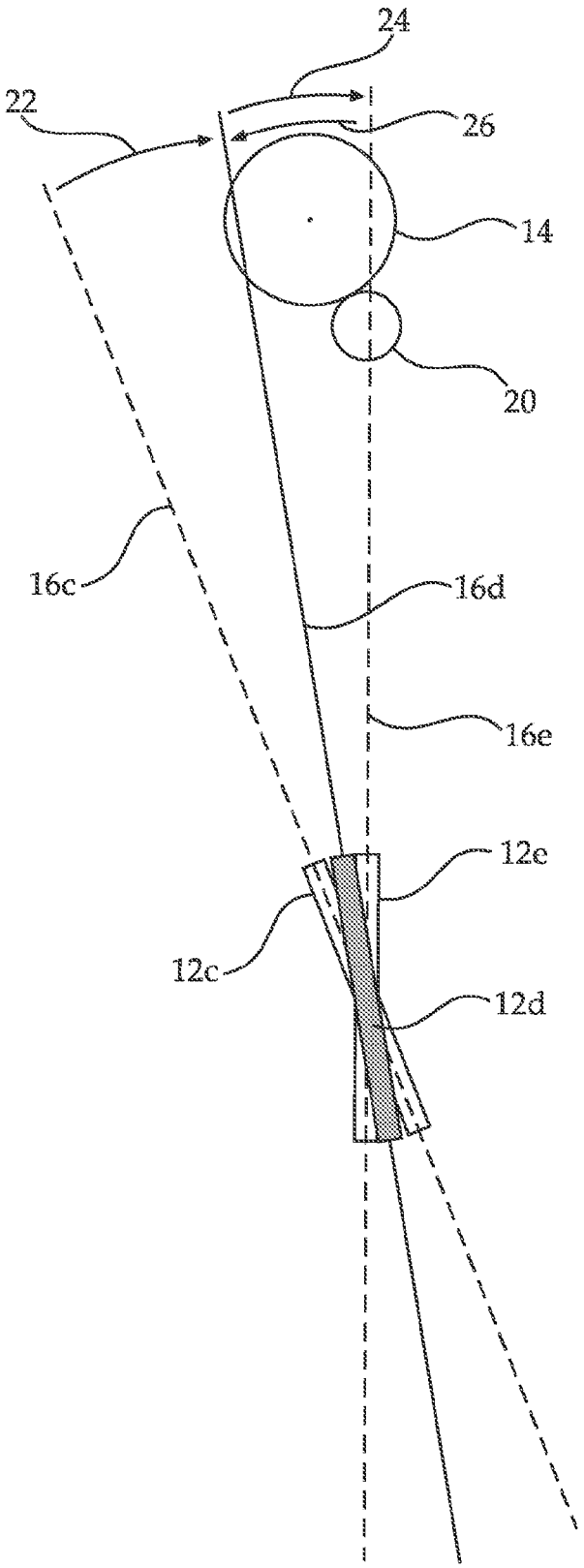
FIG. 2 is a schematic depiction of an alternative implementation of an embodiment of the teachings herein.

A second embodiment of the method according to the teachings herein is schematically depicted in FIG. 2, a view from above of an operator (not depicted) trying to shoot a watermelon 14 that is partially screened by a Galia melon 20. The firearm is shown in three superimposed states in FIG. 2: state c (aimed to the left of watermelon 14, wherein the firearm is depicted as 12*c*), state d (aimed at watermelon 14, wherein the firearm is depicted as 12*d*) and state e (aimed at Galia melon 20, wherein the firearm is depicted as 12*e*).

As discussed above with reference to FIG. 1, in FIG. 2 in the first state c, the barrel of firearm 12*c* is pointed so that aiming line 16*c* is to the left of watermelon 14 so that a characteristic of the audible signal generated in accordance with the teachings herein corresponds to a range to a point that is at a much greater distance than watermelon 14. As a result, the operator does not discharge firearm 12*c*, but instead, sweeps the barrel of firearm 12*c* in an arc, such as an arc 22, to state d, in which the firearm is depicted as 12*d*.

When the barrel of firearm 12*d* is pointed so that aiming line 16*d* and the barrel vector are aimed at watermelon 14, the audible signal generated in accordance with the teachings herein is modulated such that at least one characteristic of the signal corresponds to the range to watermelon 14. However, if the operator is uncertain whether the barrel of firearm 12*d* is aimed at watermelon 14 (aiming line 16*d*) or at Galia melon 20 (aiming line 16*e*), the operator continues sweeping the barrel of firearm 12 in an arc, such as an arc to the right 24 to state e in which the firearm is depicted as 12*e*, along aiming line 16*e*.

During the sweeping of the barrel of firearm 12*d* to firearm 12*e* in arc 24 from aiming line 16*d* to aiming line 16*e*, there is a substantial discontinuity in the modulation of the audible signal when the aiming line first intersects Galia melon 22, e.g., a sudden jump from a high-frequency to a higher-frequency tone. Such a substantial discontinuity in the modulation of the audible signal indicates to an operator that firearm 12*e* is aimed at Galia melon 22 along aiming line 16*e*.

As a result, the operator sweeps the barrel of firearm 12*e* to the left in arc 26 to firearm 12*d*. During the sweeping of the barrel of firearm 12*e* to the left in arc 26 from aiming line 16*e* to aiming line 16*d*, there is a substantial discontinuity in the modulation of the audible signal when the aiming line passes Galia melon 20, e.g., a sudden jump from a higher-frequency to a high-frequency tone. Such a substantial discontinuity in the modulation of the audible signal indicates to the operator that firearm 12*d* is aimed at watermelon 14 and not Galia melon 20. The operator understands that firearm 12*d* is properly aimed and discharges firearm 12*d* to hit watermelon 14 with a projectile along a line of fire that is substantially the same as aiming line 16*d*.

Device Useful in Helping Aiming a Firearm

The method as described above can be implemented using any suitable device. That said, in some embodiments it is preferred to use a device useful in helping aiming a firearm according to the teachings herein.

According to an aspect of some embodiments of the teachings herein, there is also provided a device useful in helping to aim a firearm, comprising:

a) a range-determining unit configured for mounting on a firearm, further configured for determining the range to an object along an aiming line at a range-determining rate of at least as frequent as once a second; and b) a reporting unit functionally associated with the range-determining unit, configured to generate a signal audible to a human operator during when the range-determining unit determines the range, wherein at least one characteristic of the signal is modulated as a function of a range determined by the range-determining unit.

In some embodiments, the reporting unit is configured to continuously generate the audible signal when the range-determining unit is determining a range. In some embodiments, the reporting unit is configured to continuously generate the audible signal when the range-determining unit is determining a range and the reporting unit is activated.

The range-determining rate is any suitable range-determining rate of at least as frequent as once a second. Accordingly, in some embodiments, the range-determining rate is at least as frequent as five times a second, at least as frequent as ten times a second, at least as frequent as 15 times a second, at least as frequent as 30 times a second, at least as frequent as 60 times a second, at least as frequent as 80 times a second, at least as frequent as 100 times a second and even at least as frequent as 200 times a second.

In some embodiments, the device is configured for mounting such that the aiming line is substantially parallel with a barrel vector of the firearm. In some embodiments, the device is configured for mounting such that the aiming line converges with a barrel vector at a point distant from the muzzle of the firearm in the direction of fire of the firearm.

In some embodiments, the device is configured so that when mounted on a firearm, the aiming line is offset from the barrel vector at the muzzle of the firearm, by not more than 5 cm, not more than 4 cm, not more than 3 cm, and even not more than 2 cm.

In some embodiments, the reporting unit is in wireless communication with the range-determining unit. Any suitable wireless modality can be used, including, infrared modality, ultrasonic modality, radio modality (e.g., Bluetooth®, WiFi).

In some embodiments, the reporting unit is physically connected to the range-determining unit. In some embodiments, the reporting unit is not physically connected to the firearm.

In some embodiments, the reporting unit is configured to be worn by a human operator.

In some embodiments the reporting unit is an earpiece (analogous to component 68 in FIG. 2 of WO 2012/077039, or as depicted below).

In some embodiments, the reporting unit is a walkie-talkie known in the art of security communications, as discussed above with reference to the method of the teachings herein.

In some embodiments, the characteristic of the signal is frequency of the signal. In some embodiments, the frequency is such that a higher audible frequency indicates a closer range and a lower audible frequency indicates a longer range. That said, in some embodiments, the frequency is such that a lower audible frequency indicates a closer range and a higher audible frequency indicates a longer range. In some embodiments, the audible signal has a frequency between 20 and 20000 Hz. That said, in some embodiments, it is preferred that the audible signal has a frequency between 200 Hz and 800 Hz.

In some embodiments, the activation-switch biased to a state so that when no touch of the trigger is detected, the range-determining unit does not determine the range and/or the reporting unit does not generate the audible signal.

In some embodiments, the device further comprises an activation-switch configured for functional association with (e.g., mounting on) the trigger of a firearm so that touching of the trigger causes the activation switch to activate the range-determining unit to determine the range at the range-determining rate and/or to activate the reporting unit to generate the audible signal. In some such embodiments, the activation-switch is biased to a state so that when no touch of the trigger is detected, the range-determining unit does not determine the range and/or the reporting unit does not generate the audible signal. For example, in some such embodiments, the activation switch includes two spaced-apart electrodes constituting a break in an activation circuit: touching of the trigger by skin of a finger completes the activation circuit. For example, in some such embodiments, the activation switch includes a spring-loaded microswitch biased in a normally outwards state constituting a break in an activation circuit: touching of the trigger presses the microswitch into an inwards state that completes the activation circuit.

Firearm

According to an aspect of some embodiments of the teachings herein, there is also provided a firearm comprising:

a firearm body including a barrel having a muzzle at a distal end; and mounted on the firearm body, a range-determining unit of a device useful in helping aiming a firearm as described herein.

In some embodiments, the range-determining unit is mounted on the firearm body such that the aiming line of the range-determining unit is substantially parallel with the barrel vector of the firearm.

In some embodiments, the range-determining unit is mounted on the firearm body such that the aiming line converges with the barrel vector at a point distant from the muzzle of the firearm in the direction of fire of the firearm.

In some embodiments, the range-determining unit is mounted on the firearm body such that the aiming line is offset from the barrel vector at the muzzle of the firearm, by not more than 5 cm, not more than 4 cm, not more than 3 cm, and even not more than 2 cm.

In some embodiments, the firearm further comprises an activation-switch functionally associated with (e.g., mounted on) the trigger of the firearm so that touching of the trigger causes the activation switch to activate the range-determining unit to start the range determining and/or to activate the reporting unit to generate the audible signal. In some such embodiments, the activation-switch is biased to a state so that no touch of the trigger stops the determining by the range-determining unit and/or stops the generating of the audible signal by the reporting unit. For example, in some such embodiments, the activation switch includes two spaced-apart electrodes constituting a break in an activation circuit: touching of the trigger by skin of a finger completes the activation circuit. For example, in some such embodiments, the activation switch includes a spring-loaded microswitch biased in a normally outwards state constituting a break in an activation circuit: touching of the trigger presses the microswitch into an inwards state that completes the activation circuit.

Any suitable range-determining device can be used in implementing the teachings herein. That said, a particularly suitable device is an appropriately-modified version of the device disclosed in PCT patent publication WO2012/077039 which is incorporated by reference as if fully set-forth herein. Embodiments of the appropriately-modified device of WO2012/077039 are suitable for one or more of the reasons:

suitable range-determining rate (e.g., in some embodiments, at least 15 Hz, at least 30 Hz, at least 60 Hz, at least 80 Hz, at least 100 Hz and even at least 200 Hz);

in some embodiments, the use invisible light for determining range, reducing the chance of being observed when implementing the teachings herein;

in some embodiments, suitable dimensions to be mounted on a firearm, including a handgun, in terms of weight and size that allow the firearm to be used in the usual way without being excessively bulky, in a large part due to the interaperture separation of the device of WO2012/077039 being not more than 5 cm, not more than 4 cm, not more than 3 cm, not more than 2 cm and even not more than 1 cm;

in some embodiments, dimensions that allow the aiming line along which the range is determined to be close to the barrel vector of a firearm, primarily due to the small interaperture separation;

in some embodiments, the barrel of the firearm is placed between the light-source aperture and the light-detector aperture so that the aiming line is very close to the barrel vector; and In some embodiments, the range-dependent range resolution of the device of WO2012/077039 that gives a useful range-resolution at ranges relevant for the teachings herein.

Figure 3:
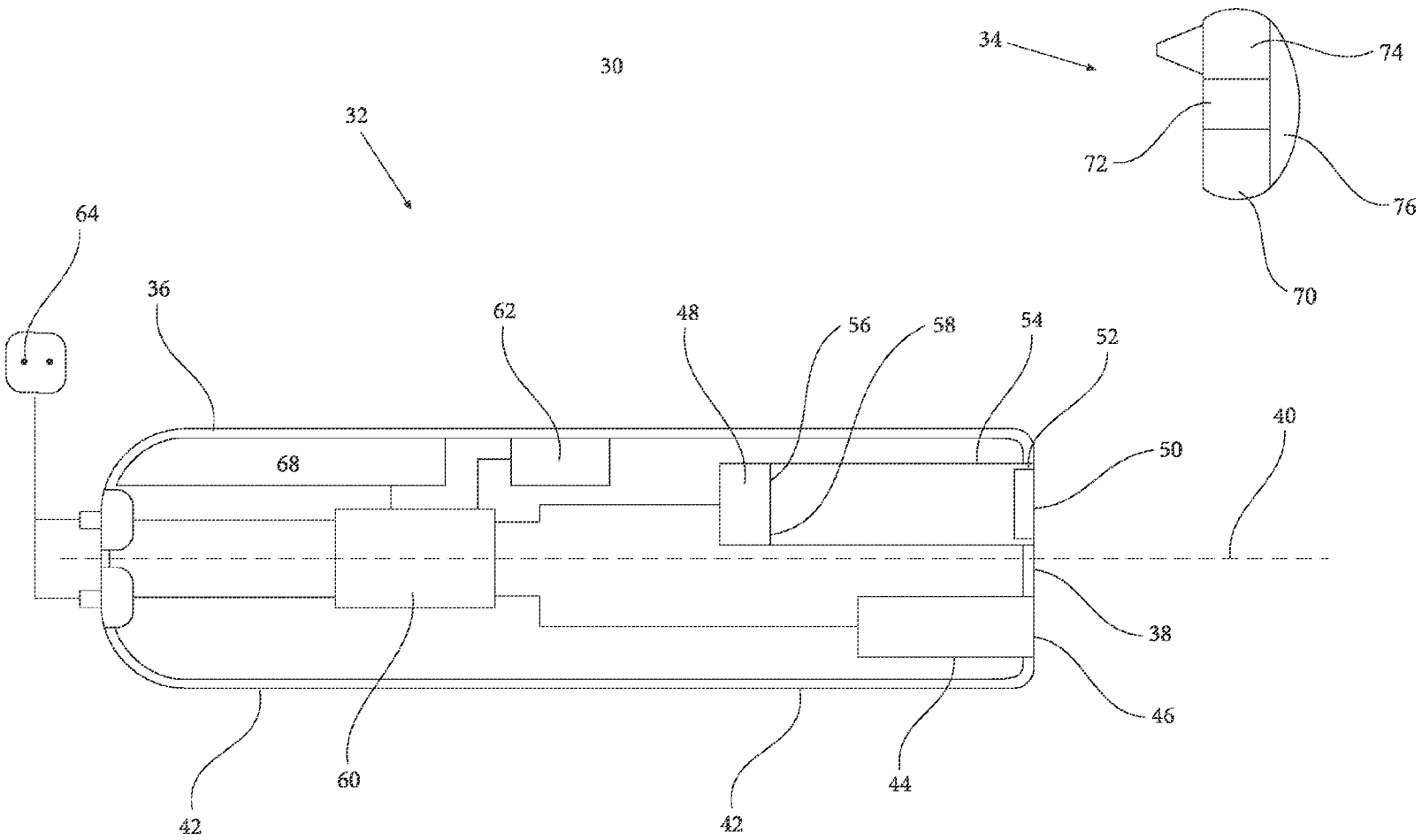
FIG. 3 is a schematic depiction of an embodiment of device useful in helping to aim a firearm according to the teachings herein.

Such an embodiment of a device useful in helping to aim a firearm according to the teachings herein that is a variant of the device disclosed in WO2012/077039, device 30 is schematically depicted in FIG. 3. Device 30 has two physically-separate units: range-determining unit 32, schematically depicted in top cross section and reporting unit 34, schematically depicted in side cross section.

Range-determining unit 32 comprises an elongated housing 36 having a front end 38 and an axis 40. Functionally associated with housing 36 are mounting rings 42 configured for mounting range-determining unit 30 to a firearm through a Picatinny rail.

Contained inside housing 36 is a light-source 44 with a light-source aperture 46. Light source 44 is a class I near-infrared laser configured for projecting a continuous beam of substantially monochromatic light with a wavelength of 780 nm and a beam divergence of 1 mrad. Light source 44 is secured in housing 36 so that the projected beam of light is projected substantially in parallel to axis 40 defining the aiming line of range-determining unit 32.

Also contained inside housing 36 is a light detector 48, a 2048×1536 (3.1 megapixel) two-dimensional CCD array having a 60 fps frame rate known in the art of digital photography able to detect, inter alia, light having a wavelength of 780 nm, available, for example from Vision Research Inc. (Wayne, N.J., USA). A light-detector aperture 50 is separated by 3 cm from light-source aperture 46 and is functionally associated with a narrow pass light filter 52 configured to pass only light having a wavelength of about 780 nm. Light-detector 48 is functionally associated with a telephoto lens 54 having an angle of view of 6°. In accordance with the teachings of WO2012/077039 telephoto lens 54 and light-detector 48 are mounted so that light projected by light source 44 and reflected from an object at a distance of 0.5 m is detected at a first detection location 56 and light reflected from an object at 40 m is detected at a second detection location 58. In this context, it is important to note that the angles and marking of detection locations 56 and 58 in FIG. 3 are not to scale and are distorted for clarity. The epipolar line between first detection location 56 and second detection location 58 includes 1000 pixels, each constituting a distinct detection location.

Contained inside housing 36 is a processor 60 (a general purposed integrated circuit) functionally associated with light source 44, light detector 48 and a wireless transceiver 62 (e.g., a Bluetooth® transmitter such as Avantalk BTDG-20 by Avantalk Ltd., Shenzen, China). Processor 60 is functionally associated with two electrodes 64 functionally associated with adhesive patch 66, adhesive patch allowing attaching electrodes to a trigger of a firearm, as described below. Electrodes 64 are components of an activation switch of range-determining unit 32, as described below.

Processor 60 draws power from a power source 68 (a rechargeable battery) and distributes power as needed to the other components.

Reporting unit 34 is in the form of an earpiece, physically separate from range-determining unit 32. Reporting unit 34 is a standard Bluetooth® enabled ear-piece known in the field of cellular telephones (e.g., Nokia Bluetooth Headset BH-209 from Nokia, Espoo, Finland) configured to be worn in proximity of the ear of a user. Reporting unit 34 comprises a wireless (Bluetooth®) transceiver 70, a processor 72 (a general purpose integrated circuit) with an on/off switch (not depicted), an audible signal generator 74 (speaker) and an earpiece power source 76 (rechargeable battery).

Processor 60 is configured for controlling operation of light-source 44 and light-detector 48, including calculating a detection location along the epipolar line of light detector 48 as the center of a group of pixels that detect light projected from light source 44, being reflected from a reflecting object, and entering light-detector aperture 50, in accordance with the teachings of WO2012/077039.

Processor 60 is also configured to transmit an electronic signal using wireless transceiver 62 to audible signal generator 74 in reporting unit 34 at a reporting rate of 60 Hz, to produce an audible signal in accordance with the teachings herein having a frequency of between 300 Hz and 600 Hz as a function of a detection location: a 300 Hz signal corresponding to first detection location 56 (minimum distance), a 600 Hz signal corresponding to second detection location 58 (maximum distance) with intermediate frequencies corresponding to intermediate detection locations. Specifically, processor 60 is configured so that each of the 1000 distinct detection locations are mapped onto the 300 Hz range of frequencies between 300 Hz and 600 Hz, so that the signal generator produces 1000 distinct frequencies separated by about 0.33 Hz between 300 Hz and 600 Hz, corresponding to the 1000 distinct detection locations.

For use, range-determining unit 32 is mounted on the Picattiny rail of a firearm using mounting rings 42, electrodes 64 are functionally associated with the trigger of the firearm using adhesive patch 66 and reporting unit 34 is placed behind the ear of a user.

In the absence of contact of a conductor such as a finger on the trigger and therefore electrodes 64, the activation circuit of range-determining unit 32 is open so that range is not determined and no audible signal is generated.

When a conductor such as a finger touches the trigger and contacts electrodes 64, the activation circuit is closed, range-determining unit 32 is activated for repeated range-determination at the range-determining rate and reporting unit 34 generates the audible signal in accordance with the teachings herein.

In greater detail, and as described in WO2012/077039, when the activation circuit is closed, processor 60 provides power to light-source 44 to produce a beam of light exiting from light-source aperture 46 in parallel to axis 40, the aiming line. When the beam of light is reflected by an object, the reflected light enters through light-detector aperture 50, passes through light filter 52 and is directed by telephoto lens 54 to a location on light-detector 48 to illuminate an area on and around the epipolar line of light-detector 48 consisting of one or more individual light-detecting elements (pixels).

At the frame rate, processor 72 calculates which pixel on the epipolar line corresponds to the center of the illuminated area and designates that pixel as the current detection location. Processor 60 sends an appropriate command through wireless transceiver 62 at the reporting rate. The command is received by wireless transceiver 70 of reporting unit 34, that is translated by earpiece processor 72 to cause audible signal generator 74 to generate an audible signal having a frequency that corresponds to the current detection location. As the detection location is a function of the range determined to the object, the audible signal is thereby frequency modulated as a function of the determined range.

Figure 4:
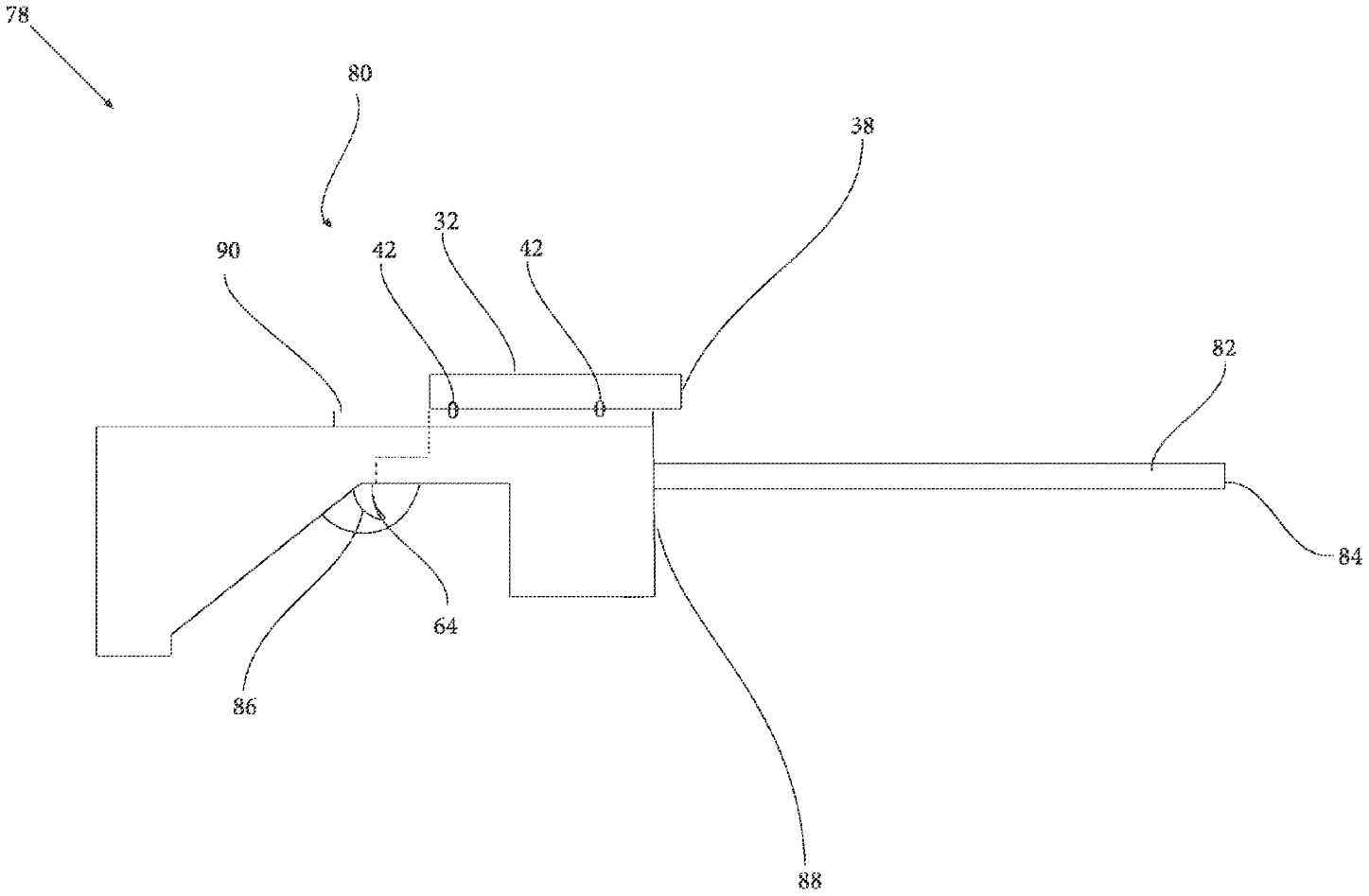
FIG. 4 is a schematic depiction of an embodiment of a firearm according to the teachings herein.

An embodiment of a firearm according to the teachings herein, firearm 78 is schematically depicted in side view in FIG. 4.

Firearm 78 comprises a firearm body 80 including a barrel 82, a muzzle 84 at the distal end of barrel 82, a trigger 86 and a receiver 88 bearing a Picatinny rail 90 known in the art as an adaptor allowing the functional association of accessories to firearms such as 78.

A range-determining unit 32 as described in FIG. 3 is mounted on firearm body 80 through Picatinny rail 90 using mounting rings 42 so that the aiming line of range-determining unit 32 is substantially parallel with the barrel vector of firearm 78 but offset from the barrel vector at muzzle 84 by 5 cm.

Electrodes 64 of the activation switch of range-determining unit 32 are functionally associated with trigger 86 (mounted with the help of adhesive patch 66).

In the absence of contact of a conductor such as a finger on trigger 86 and therefore electrodes 64, the activation circuit of range-determining unit 32 is open so that range is not determined and no audible signal is generated.

When a conductor such as a finger touches trigger 86 and contacts electrodes 64, the activation circuit is closed, range-determining unit 32 is activated for repeated range-determination at the range-determining rate and the associated reporting unit (34 depicted in FIG. 3, but not depicted in FIG. 4) generates an audible signal in accordance with the teachings herein.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the scope of the appended claims.

Citation or identification of any reference in this application shall not be construed as an admission that such reference is available as prior art to the invention.

The invention claimed is:

1. A method of aiming a firearm operated by an operator, comprising:

a) at a range-determining rate of at least as frequent as once a second, determining the range to an object along an aiming line of a firearm;

b) generating a signal audible to the operator, wherein at least one characteristic of said audible signal is modulated as a function of said determined range; and c) discharging said firearm in response to said characteristic of said signal;

wherein said discharging is when said characteristic of said signal indicates to said operator that said firearm is properly aimed.

2. The method of claim 1, wherein said range-determining rate is at least as frequent as 5 times a second.

3. The method of claim 2, wherein said range-determining rate is at least as frequent as 10 times a second.

4. The method of claim 1, wherein said audible signal is generated by a reporting unit that is in wireless communication with a component performing said determining of the range.

5. The method of claim 1, wherein said audible signal is generated by a reporting unit that is not physically connected to said firearm.

6. The method of claim 1, wherein said characteristic of said signal is frequency of said signal.

7. The method of claim 6, wherein said frequency of said signal is such that a higher audible frequency indicates a closer range and a lower audible frequency indicates a longer range.

8. The method of claim 1, wherein said discharging of said firearm is effected without changing the direction of said aiming line of said firearm.

9. A device useful in helping to aim a firearm, comprising:

a) a range-determining unit configured for mounting on a firearm, further configured for determining the range to an object along an aiming line at a range-determining rate of at least as frequent as once a second; and b) a reporting unit functionally associated with said range-determining unit, configured to generate a signal audible to a human operator, wherein at least one characteristic of said signal modulated as a function of a range determined by said range-determining unit.

10. The device of claim 9, wherein said range-determining rate is at least as frequent as five times a second.

11. The device of claim 9, wherein said range-determining rate is at least as frequent as ten times a second.

12. The device of claim 9, wherein said reporting unit is in wireless communication with said range-determining unit.

13. The device of claim 9, wherein said reporting unit is not physically connected to said range-determining unit.

14. The device of claim 9, wherein said reporting unit is configured to be worn by a human operator.

15. The device of claim 9, wherein said characteristic of said signal is frequency of said signal.

16. The device of claim 15, wherein said frequency of said signal is such that a higher audible frequency indicates a closer range and a lower audible frequency indicates a longer range.

17. The device of claim 15, wherein said frequency of said signal is such that a lower audible frequency indicates a closer range and a higher audible frequency indicates a longer range.

18. The device of claim 9, further comprising an activation-switch configured for functional association with the trigger of a firearm so that touching of said trigger causes said activation switch to activate said range-determining unit to determine said range at said range-determining rate and/or to activate said reporting unit to generate said audible signal.

19. The device of claim 18, said activation-switch biased to a state so that when no touch of the trigger is detected, said range-determining unit does not determine said range and/or said reporting unit does not generate said audible signal.

20. A firearm comprising:

a firearm body including a barrel having a muzzle at a distal end; and mounted on said firearm body, a range-determining unit of a device of claim 9.

* * * * *